US006565455B2

(12) United States Patent
Hayashi et al.

(10) Patent No.: US 6,565,455 B2
(45) **Date of Patent: *May 20, 2003**

(54) MULTI-PIECE GOLF BALL

(75) Inventors: Junji Hayashi, Chichibu (JP); Rinya Takesue, Chichibu (JP); Toshiaki Yamanaka, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/778,828

(22) Filed: Feb. 8, 2001

(65) Prior Publication Data

US 2001/0018375 A1 Aug. 30, 2001

(30) Foreign Application Priority Data

Feb. 10, 2000 (JP) ..... 2000-033183

(51) Int. Cl.[7] ..... A63B 37/04; A63B 37/06; A63B 37/12; A63B 37/14; A63B 37/00

(52) U.S. Cl. ..... 473/371; 473/378; 473/351

(58) Field of Search ..... 473/351, 354, 473/356, 355, 357, 358, 359, 360, 361, 362, 363, 364, 365, 367, 368, 370, 371, 372, 373, 374, 375, 376, 377, 378

(56) References Cited

U.S. PATENT DOCUMENTS

| | | | |
|---|---|---|---|
| 3,404,134 | A | 10/1968 | Rees |
| 3,959,539 | A | 5/1976 | Waggoner |
| 4,526,375 | A | 7/1985 | Nakade |
| 4,984,804 | A | 1/1991 | Yamada et al. |
| 4,999,404 | A | 3/1991 | Matsuki |
| 5,019,320 | A | 5/1991 | Hasegawa et al. |
| 5,306,760 | A | 4/1994 | Sullivan |
| 5,439,227 | A | 8/1995 | Egashira et al. |
| 5,559,188 | A | 9/1996 | Egashira et al. |
| 5,605,968 | A | 2/1997 | Egashira et al. |
| 5,779,561 | A | 7/1998 | Sullivan et al. |
| 5,803,831 | A | 9/1998 | Sullivan et al. |
| 5,824,740 | A | 10/1998 | Yabuki et al. |
| 5,902,855 | A | 5/1999 | Sullivan et al. |
| 5,929,189 | A | 7/1999 | Ichikawa et al. |

(List continued on next page.)

FOREIGN PATENT DOCUMENTS

| | | |
|---|---|---|
| GB | 1113409 | 5/1968 |
| GB | 2 278 609 | 12/1994 |
| JP | 5-3931 | 1/1993 |
| JP | 9-117532 A1 | 5/1997 |
| JP | 9-313643 | 12/1997 |
| JP | 10-305114 | 11/1998 |
| WO | WO 98/46671 | 10/1998 |
| WO | WO 01/23519 A1 | 4/2001 |
| WO | WO 01/29129 A1 | 4/2001 |

OTHER PUBLICATIONS

British Search Report dated Jul. 6, 2001.

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

In a multi-piece golf ball comprising a solid core, an intermediate layer, and a cover, the intermediate layer and/or the cover is formed of a heated mixture having a melt index of at least 1.0 dg/min and comprising (a) an olefin-carboxylic acid random copolymer and/or (d) a metal ion-neutralized olefin-carboxylic acid random copolymer and/or a metal ion-neutralized olefin-carboxylic acid-carboxylate random copolymer; (b) a fatty acid or derivative having a molecular weight of at least 280; and (c) a neutralizing basic inorganic metal compound. All expressed in Shore D hardness, the intermediate layer has a hardness of 40–63, the cover has a hardness of 45–68, and they satisfy the relationship: the hardness of solid core at its center≦the hardness of intermediate layer≦the hardness of cover.

5 Claims, 1 Drawing Sheet

U.S. PATENT DOCUMENTS 5,948,859 A 9/1999 Sano et al.
5,952,415 A * 9/1999 Hwang ..... 473/372
5,976,443 A * 11/1999 Nesbitt et al. ..... 264/250
5,994,470 A 11/1999 Tanaka et al.
6,018,003 A 1/2000 Sullivan et al.
6,034,182 A 3/2000 Kashiwagi et al.
6,100,321 A 8/2000 Chen
6,245,858 B1 * 6/2001 Sullivan et al. ..... 473/372
6,319,153 B1 * 11/2001 Nesbitt et al. ..... 473/377
6,325,731 B1 * 12/2001 Kennedy et al. ..... 473/377
6,329,458 B1 * 12/2001 Takesue et al. ..... 473/351

* cited by examiner

MULTI-PIECE GOLF BALL

This invention relates to multi-piece golf balls of at least three layers including a solid core, an intermediate layer and a cover, which are improved in feel, control and flight performance.

BACKGROUND OF THE INVENTION

In the past, a variety of improvements were made on wound golf balls and solid golf balls. One typical attempt is to optimize the gage and hardness of the core and cover of a two-piece solid golf ball.

While most prior art solid golf balls have a two-layer structure consisting of a solid core and a cover, the recent trend has moved to a multilayer structure having an intermediate layer disposed between the solid core and the cover. Many attempts have been made to optimize the respective layers. For instance, JP-A 9-313643 discloses a three-piece golf ball which is improved in flight performance, durability, feel and controllability by optimizing the hardness distribution of the core alone and the overall hardness distribution of the ball including the core, intermediate layer and cover.

Also, JP-A 10-305114 discloses a multi-piece golf ball which is improved in flight performance and feel by optimizing the hardness balance among the core, intermediate layer and cover as well as the dimples.

Nowadays, golf players have a variety of diverse requirements, and further improvements in feel, controllability and flight performance are needed.

SUMMARY OF THE INVENTION

An object of the invention is to provide a multi-piece golf ball of at least three layers including a solid core, an intermediate layer and a cover, which is improved in feel, controllability and flight performance.

Regarding a golf ball comprising a solid core, an intermediate layer and a cover, the inventor has attempted to use a heated mixture of any one of the following compositions (1), (2) and (3) and having a melt index of at least 1 dg/min as the material of which the intermediate layer and/or the cover is made.

Composition (1) comprising the following:

(a) 100 parts by weight of an olefin-unsaturated carboxylic acid random copolymer and/or an olefin-unsaturated carboxylic acid-unsaturated carboxylate random copolymer, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (a) and (b).

Composition (2) comprising the following:

(d) 100 parts by weight of a metal ion-neutralized olefin-unsaturated carboxylic acid random copolymer and/or a metal ion-neutralized olefin-unsaturated carboxylic acid-unsaturated carboxylate random copolymer, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (d) and (b).

Composition (3) comprising the following:

100 parts by weight of a mixture of (a) an olefin-unsaturated carboxylic acid random copolymer and/or an olefin-unsaturated carboxylic acid-unsaturated carboxylate random copolymer and (d) a metal ion-neutralized olefin-unsaturated carboxylic acid random copolymer and/or a metal ion-neutralized olefin-unsaturated carboxylic acid-unsaturated carboxylate random copolymer, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (a), (d) and (b).

It has been found that the multi-piece golf ball whose intermediate layer and/or cover is formed of the above-formulated material is improved in rebound and flight distance. This improvement in rebound leads to the advantage that there is left a room for further improvements in feel and controllability.

Continuing investigations in order to take the advantage to a full extent, the inventor has found that the improvement in rebound contributes to a softening of feel, and with respect to controllability, the same allows the cover to be softened so that an increased spin receptivity is expectable.

More specifically, the hardnesses of the respective layers of the multi-piece golf ball are such that the intermediate layer has a Shore D hardness of 40 to 63, the cover has a Shore D hardness of 45 to 68, the Shore D hardness of the solid core at its center is not greater than the Shore D hardness of the intermediate layer, which is not greater than the Shore D hardness of the cover. When the ball is hit, the ball receives the impact force over its entirety, rather than local concentration of the impact force, so that the energy loss associated with ball deformation is minimized. This leads to good rebound or restitution, an increase of travel distance and a soft feel. Additionally, the cover can be made so soft that spin receptivity is increased to provide for good controllability. The present invention is predicated on these findings.

In a first aspect, the invention provides a multi-piece golf ball comprising a solid core, an intermediate layer enclosing the solid core, and a cover enclosing the intermediate layer, wherein at least one of the intermediate layer and the cover is formed of a heated mixture comprising (a) 100 parts by weight of an olefin-unsaturated carboxylic acid random copolymer or an olefin-unsaturated carboxylic acid-unsaturated carboxylate random copolymer or both, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (a) and (b), the heated mixture having a melt index of at least 1.0 dg/min, the intermediate layer has a Shore D hardness of 40 to 63, the cover has a Shore D hardness of 45 to 68, the Shore D hardness of the solid core at its center is not greater than the Shore D hardness of the intermediate layer, which is not greater than the Shore D hardness of the cover.

In a second aspect, the invention provides a multi-piece golf ball comprising a solid core, an intermediate layer enclosing the solid core, and a cover enclosing the intermediate layer, wherein at least one of the intermediate layer and the cover is formed of a heated mixture comprising (d) 100 parts by weight of a metal ion-neutralized olefin-unsaturated carboxylic acid random copolymer or a metal ion-neutralized olefin-unsaturated carboxylic acid-unsaturated carboxylate random copolymer or both, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (d) and (b), the heated mixture having a melt index of at least 1.0 dg/min, the intermediate layer has a Shore D hardness of 40 to 63, the cover has a Shore D hardness of 45 to 68, the Shore D hardness of the solid core at its center is not greater than the Shore D hardness of the intermediate layer, which is not greater than the Shore D hardness of the cover.

In a third aspect, the invention provides a multi-piece golf ball comprising a solid core, an intermediate layer enclosing the solid core, and a cover enclosing the intermediate layer, wherein at least one of the intermediate layer and the cover is formed of a heated mixture comprising 100 parts by weight of a mixture of (a) an olefin-unsaturated carboxylic acid random copolymer or an olefin-unsaturated carboxylic acid-unsaturated carboxylate random copolymer or both and (d) a metal ion-neutralized olefin-unsaturated carboxylic acid random copolymer or a metal ion-neutralized olefin-unsaturated carboxylic acid-unsaturated carboxylate random copolymer or both, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (a), (d) and (b), the heated mixture having a melt index of at least 1.0 dg/min, the intermediate layer has a Shore D hardness of 40 to 63, the cover has a Shore D hardness of 45 to 68, the Shore D hardness of the solid core at its center is not greater than the Shore D hardness of the intermediate layer, which is not greater than the Shore D hardness of the cover.

In one preferred embodiment, the solid core is formed of a polybutadiene-based rubber composition and has a diameter of 33 to 41 mm and a deflection of 2.5 to 7.0 mm under an applied load of 100 kg.

In another preferred embodiment, the intermediate layer has a gage of 0.3 to 3.0 mm, the cover has a gage of 0.3 to 3.0 mm, and the total gage of the intermediate layer and the cover is at least 1.0 mm.

BRIEF DESCRIPTION OF THE DRAWING

The only FIGURE.

DESCRIPTION OF THE PREFERRED EMBODIMENT

Figure 1:
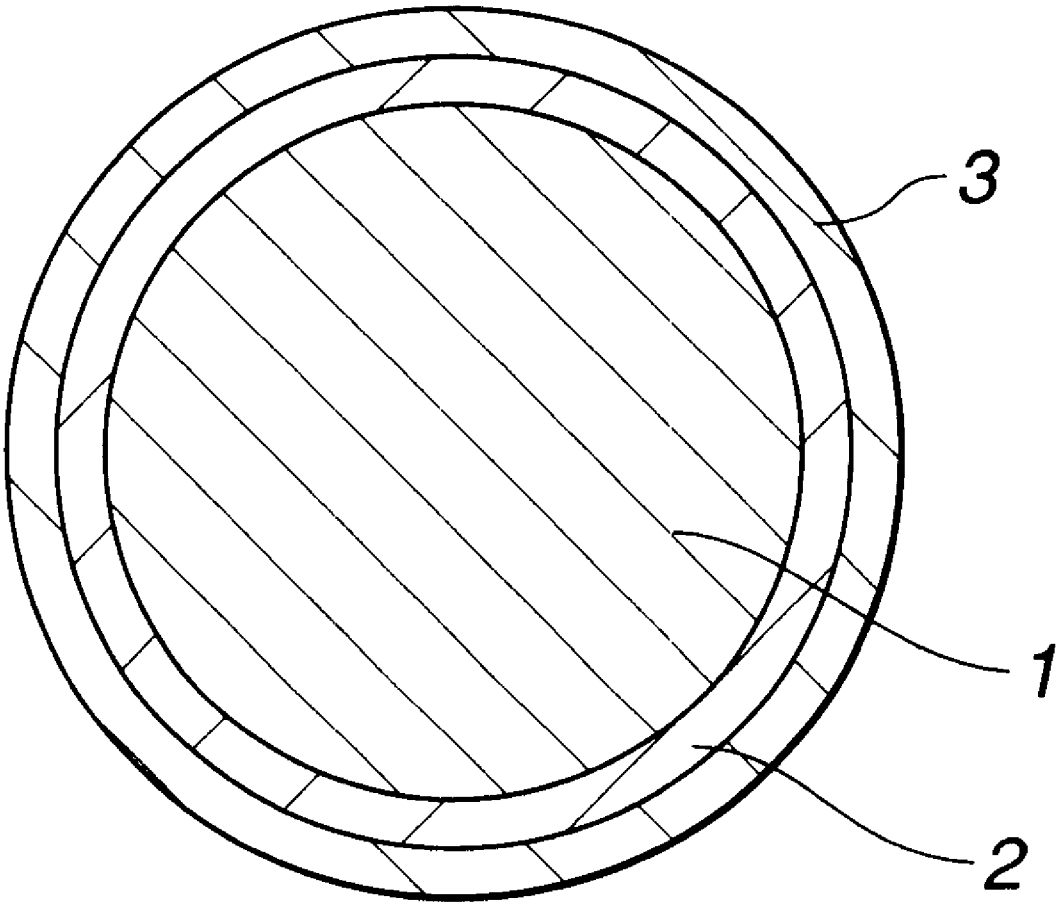
FIG. 1 is a schematic cross-sectional view of a three-piece golf ball according to one embodiment of the invention.

Referring to the FIGURE, a multi-piece golf ball according to the invention is illustrated as having at least three layers including a solid core 1, an intermediate layer or mantle 2 enclosing the solid core 1, and a cover 3 enclosing the intermediate layer 2, all in a concentric fashion. Although each of the solid core 1, intermediate layer 2 and cover 3 is illustrated as a single layer, it may have a multilayer structure of two or more sublayers. That is, each of the solid core 1, intermediate layer 2 and cover 3 may consist of a plurality of sublayers if necessary. While the details of the solid core 1, intermediate layer 2 and cover 3 are described below, in the event wherein any component is formed to a multilayer structure, that component in its entirety should satisfy the requirements to be described below.

The solid core may be formed of any well-known core material, for example, a rubber composition. A rubber composition comprising polybutadiene as a base rubber is preferred. The preferred polybutadiene is cis-1,4-polybutadiene containing at least 40% cis configuration.

In the rubber composition, a crosslinking agent may be blended with the base rubber. Exemplary crosslinking agents are zinc and magnesium salts of unsaturated fatty acids such as zinc dimethacrylate and zinc diacrylate, and esters such as trimethylpropane methacrylate. Of these, zinc diacrylate is preferred because it can impart high resilience. The crosslinking agent is preferably used in an amount of about 5 to 40 parts by weight per 100 parts by weight of the base rubber.

A vulcanizing agent such as dicumyl peroxide or a mixture of dicumyl peroxide and 1,1-bis(t-butylperoxy)-3,3,5-trimethylcyclohexane may also be blended in the rubber composition, preferably in an amount of about 0.1 to 5 parts by weight per 100 parts by weight of the base rubber. Dicumyl peroxide is commercially available, for example, under the trade name of Percumyl D from NOF Corp.

In the rubber composition, an antioxidant and a specific gravity adjusting filler such as zinc oxide or barium sulfate may be blended. The amount of filler blended is 0 to about 130 parts by weight per 100 parts by weight of the base rubber.

A solid core is produced from the core-forming rubber composition by kneading the above-mentioned components in a conventional mixer such as a kneader, Banbury mixer or roll mill. The resulting compound is molded in a mold by compression molding or other suitable molding techniques.

The solid core has a Shore D hardness at its center which should satisfy, in conjunction with the Shore D hardnesses of the intermediate layer and the cover, the relationship: hardness of solid core center≦hardness of intermediate layer≦hardness of cover, and preferably hardness of solid core center≦hardness of solid core surface≦hardness of intermediate layer≦hardness of cover. It is most preferred that the hardness gradually increase from the center of the solid core to the outer surface of the cover. This hardness requirement will be described later.

The specific Shore D hardness of the solid core is not critical insofar as the above relationship is met. The Shore D hardness of the solid core is adjusted as appropriate in accordance with the Shore D hardnesses of the intermediate layer and the cover. Preferably the Shore D hardness of the solid core at the center is usually up to 45, especially up to 40, and its lower limit is at least 15, especially at least 20. It is recommended that the Shore D hardness of the solid core at its surface be adjusted as appropriate in accordance with the Shore D hardness thereof at the center. Preferably the Shore D hardness of the solid core at the surface is usually up to 60, especially up to 55, and its lower limit is at least 20, especially at least 25. It is recommended that the hardness difference between the solid core surface and the solid core center be usually up to 30 units, especially up to 25 units in Shore D, and the lower limit be at least 0 unit, preferably at least 3 units, especially at least 5 units in Shore D.

It is recommended that the solid core have a diameter of usually at least 33 m, preferably at least 34 mm, and more preferably at least 35 mm, and the upper limit be up to 41 mm, preferably up to 40 mm, and more preferably up to 39 mm. A too small diameter means that a soft core becomes small, which may lead to a hard feel. A too large diameter necessarily requires the intermediate layer and the cover to be thinner, which may exacerbate rebound and durability.

It is recommended the solid core have a deflection under an applied load of 100 kg of at least 2.5 mm, more preferably at least 2.8 mm, further preferably at least 3.2 mm, and its upper limit be up to 7.0 mm, more preferably up to 6.5 mm, further preferably up to 6.0 mm. With too small a core deflection, the feel of the ball would become hard. With too much a core deflection, resilience and durability would become poor.

While the golf ball of the invention is of the construction that the solid core 1 is successively enclosed with the intermediate layer 2 and the cover 3 as illustrated in FIG. 1, the invention requires that at least one of the intermediate layer and the cover be formed of a heated mixture of any one of the following compositions (1) to (3), having a melt index of at least 1 dg/min.

Composition (1) comprising the following:

(a) 100 parts by weight of an olefin-unsaturated carboxylic acid random copolymer and/or an olefin-unsaturated carboxylic acid-unsaturated carboxylate random copolymer, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (a) and (b).

Composition (2) comprising the following:

(d) 100 parts by weight of a metal ion-neutralized olefin-unsaturated carboxylic acid random copolymer and/or a metal ion-neutralized olefin-unsaturated carboxylic acid-unsaturated carboxylate random copolymer, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (d) and (b).

Composition (3) comprising the following:

100 parts by weight of a mixture of (a) an olefin-unsaturated carboxylic acid random copolymer and/or an olefin-unsaturated carboxylic acid-unsaturated carboxylate random copolymer and (d) a metal ion-neutralized olefin-unsaturated carboxylic acid random copolymer and/or a metal ion-neutralized olefin-unsaturated carboxylic acid-unsaturated carboxylate random copolymer, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (a), (d) and (b).

The heated mixture of any one of compositions (1) to (3) and having a melt index of at least 1 dg/min is so thermally stable, flowable and moldable as to contribute to the manufacture of a high rebound golf ball. Using such a material, the invention facilitates the operation during formation of the intermediate layer and/or cover and succeeds in the manufacture of a high rebound golf ball.

The respective components are described below. Component (a) is a copolymer containing an olefin. Generally, the olefin in component (a) has at least 2 carbon atoms, but not more than 8 carbon atoms, and preferably not more than 6 carbon atoms. Illustrative examples include ethylene, propylene, butene, pentene, hexene, heptene and octene. Ethylene is especially preferred.

Suitable examples of the unsaturated carboxylic acid in component (a) include acrylic acid, methacrylic acid, maleic acid and fumaric acid. Of these, acrylic acid and methacrylic acid are especially preferred.

The unsaturated carboxylate in component (a) is preferably a lower alkyl ester of the foregoing unsaturated carboxylic acid. Illustrative examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The random copolymer of component (a) may be prepared by carrying out random copolymerization on the above ingredients according to a known process. It is generally recommended that the unsaturated carboxylic acid content (simply referred to as acid content) within the random copolymer be at least 2% by weight, preferably at least 6% by weight, and most preferably at least 8% by weight, but not more than 25% by weight, preferably not more than 20% by weight, and most preferably not more than 15% by weight. A low acid content may lower the resilience of the material, whereas a high acid content may lower the processability of the material.

The neutralized random copolymer serving as component (d) may be prepared by partially neutralizing acid groups in the above-mentioned random copolymer with metal ions. Examples of metal ions which may neutralize the acid groups include $Na^+$, $K^+$, $Li^+$, $Zn^{2+}$, $Cu^{2+}$, $Mg^{2+}$, $Ca^{2+}$, $Co^{2+}$, $Ni^{2+}$ and $Pb^{2+}$. The use of ions such as $Na^+$, $Li^+$, $Zn^{2+}$, $Mg^{2+}$ and $Ca^{2+}$ is preferred. $Zn^{2+}$ is especially preferred. The degree of random copolymer neutralization with these metal ions is not critical. The degree of neutralization is preferably at least 5 mol %, more preferably at least 10 mol %, most preferably at least 20 mol %, and preferably up to 95 mol %, more preferably up to 90 mol %, most preferably up to 80 mol %. A degree of neutralization of more than 95 mol % may interfere with molding whereas a degree of neutralization of less than 5 mol % may require the addition amount of the inorganic metal compound (c) to be increased, leading to an increased cost. Such neutralized random copolymers may be prepared using a method known to the art. For example, the metal ions can be introduced onto the random copolymer using formates, acetates, nitrates, carbonates, hydrogencarbonates, oxides, hydroxides or alkoxides of the metal ions.

Commercially available products are useful as components (a) and (d). Illustrative examples of the random copolymer serving as component (a) include Nucrel AN4311, AN4318 and 1560 (all produced by DuPont-Mitsui Polychemicals Co., Ltd.). Illustrative examples of the neutralized random copolymer serving as component (d) include Himilan 1554, 1557, 1601, 1605, 1706, 1855, 1856 and AM7316 (all products of DuPont-Mitsui Polychemicals Co., Ltd.); and also Surlyn 6320, 7930 and 8120 (all products of E.I. DuPont de Nemours and Company). Zinc-neutralized ionomer resins, such as Himilan AM7316, are especially preferred.

In composition (3) wherein components (a) and (d) are used in combination, the proportions in which they are blended are not subject to any particular limitations. Preferably component (a) and component (d) are blended in a weight ratio from 10:90 to 90:10, and especially from 20:80 to 80:20.

Component (b) is a fatty acid or fatty acid derivative having a molecular weight of at least 280 whose purpose is to enhance the flow characteristics of the heated mixture. It has a molecular weight which is much smaller than that of the copolymer of component (a) and/or (d), and greatly increases the melt viscosity of the mixture. Also, because the fatty acid or fatty acid derivative has a molecular weight of at least 280 and has a high content of acid groups or derivative moieties thereof, its addition to the material results in little if any loss of resilience.

The fatty acid or fatty acid derivative of component (b) used herein may be an unsaturated fatty acid or fatty acid derivative thereof having a double bond or triple bond in the alkyl group, or it may be a saturated fatty acid or fatty acid derivative in which all the bonds on the alkyl group are single bonds. It is recommended that the number of carbon atoms on the molecule generally be at least 18, but not more than 80, and preferably not more than 40. Too few carbon atoms may make it impossible to achieve heat resistance, and may also set the acid group content so high as to cause the acid groups to interact with acid groups present on component (a) and/or (d), diminishing the flow-improving effects. On the other hand, too many carbon atoms increases the molecular weight, which may also lower the flow-improving effects so as to hinder the use of the material.

Specific examples of fatty acids that may be used as component (b) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred.

Fatty acid derivatives which may be used as component (b) include derivatives in which the proton on the acid group of the fatty acid has been substituted. Exemplary fatty acid derivatives of this type include metallic soaps in which the proton has been substituted with a metal ion.

Metal ions that may be used in such metallic soaps include $Li^+$, $Ca^{2+}$, $Mg^{2+}$, $Zn^{2+}$, $Mn^{2+}$, $Al^{3+}$, $Ni^{2+}$, $Fe^{2+}$, $Fe^{3+}$, $Cu^{2+}$, $Sn^{2+}$, $Pb^{2+}$ and $Co^{2+}$. Of these, $Ca^{2+}$, $Mg^{2+}$ and $Zn^{2+}$ are especially preferred.

Specific examples of fatty acid derivatives that may be used as component (b) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Moreover, known metallic soap-modified ionomers, including those described in U.S. Pat. No. 5,312,857, U.S. Pat. No. 5,306,760 and WO 98/46671, may also be used in combination with above components (a) and/or (d) and component (b).

Component (c) is a basic inorganic metal compound capable of neutralizing the acid groups in components (a) and/or (d) and component (b). As already noted in the preamble, heating and mixing only components (a) and/or (d) and component (b), and especially only a metal-modified ionomer resin (e.g., only a metallic soap-modified ionomer resin of the type described in the above-cited patents), results in fatty acid formation due to an exchange reaction between the metallic soap and unneutralized acid groups on the ionomer, as shown below.

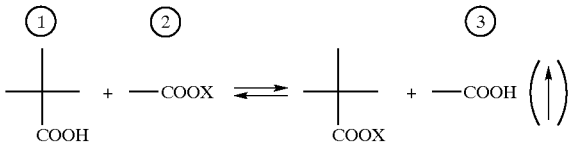

Here, (1) is an unneutralized acid group present on the ionomer resin, (2) is a metallic soap, (3) is a fatty acid, and X is a metal atom.

Because the fatty acid which forms has a low thermal stability and readily vaporizes during molding, this causes molding defects. In addition, the fatty acid which has thus formed settles on the surface of the molded article, substantially lowering the ability of a paint film to adhere thereto.

In order to resolve such problems, the present invention includes as component (c) a basic inorganic metal compound which neutralizes the acid groups present in above components (a) and/or (d) and in component (b). Incorporating component (c) serves to neutralize the acid groups in components (a) and/or (d) and in component (b). These components, when blended together, act synergistically to increase the thermal stability of the heated mixture. In addition, the blending of these components imparts a good moldability and contributes to the rebound of a golf ball.

Component (c) is a basic inorganic metal compound capable of neutralizing the acid groups in components (a) and/or (d) and component (b). The use of a monoxide or hydroxide is especially advisable. High reactivity with the ionomer resin and the absence of organic compounds in the reaction by-products enable the degree of neutralization of the heated mixture to be increased without a loss of thermal stability.

Exemplary metal ions that may be used in the basic inorganic metal compound include $Li^+$, $Na^+$, $K^+$, $Ca^{2+}$, $Mg^{2+}$, $Zn^{2+}$, $Al^{3+}$, $Ni^+$, $Fe^{2+}$, $Fe^{3+}$, $Cu^{2+}$, $Mn^{2+}$, $Sn^{2+}$, $Pb^{2+}$ and $Co^{2+}$. Examples of suitable inorganic metal compounds include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As already noted, a monoxide or hydroxide is preferred. The use of magnesium oxide or calcium hydroxide having a high reactivity with the ionomer resin is preferred, with the calcium hydroxide being especially preferred.

The heated mixture comprising components (a) and/or (d) in admixture with component (b) and component (c) as described above has improved thermal stability, moldability and resilience. It is recommended that at least 70 mol %, preferably at least 80 mol %, and most preferably at least 90 mol %, of the acid groups in the heated mixture be neutralized. Much neutralization makes it possible to more reliably suppress the exchange reaction which becomes a problem on account of the high degree of neutralization when only component (a) and/or (d) and the fatty acid or fatty acid derivative are used, and thus prevents the formation of fatty acid. As a result, there can be obtained a material of greatly increased thermal stability and good moldability which has a much larger resilience than prior-art ionomer resins.

To more reliably achieve both a high degree of neutralization and good flow characteristics, it is recommended that neutralization of the heated mixture involve neutralization of the acid groups in the heated mixture with transition metal ions and alkali metal and/or alkaline earth metal ions. Because transition metal ions have weaker ionic cohesion than alkali metal and alkaline earth metal ions, the use of transition metal ions to neutralize some of the acid groups in the heated mixture can provide a substantial improvement in the flow characteristics.

The molar ratio between the transition metal ions and the alkali metal and/or alkaline earth metal ions may be adjusted as appropriate, although a ratio within a range of from 10:90 to 90:10 is preferred, and a ratio of from 20:80 to 80:20 is especially preferred. Too low a molar ratio of transition metal ions may fail to provide a sufficient improvement in flow. On the other hand, too high a molar ratio may lower resilience.

Specific examples of the metal ions include zinc ions as the transition metal ions, and at least one type of ion selected from among sodium, lithium, magnesium and calcium ions as the alkali metal or alkaline earth metal ions.

No particular limitation is imposed on the method used to obtain a heated mixture in which the acid groups are neutralized with transition metal ions and alkali metal or alkaline earth metal ions. For example, specific methods of neutralization with transition metal ions, and in particular zinc ions, include the use of zinc soap as the fatty acid, the inclusion of a zinc-neutralized copolymer (e.g., zinc-neutralized ionomer resin) as component (d), and the use of zinc oxide as the basic inorganic metal compound of component (c).

In the practice of the invention, various additives are added to the heated mixture if desired. Such additives include pigments, dispersants, antioxidants, ultraviolet absorbers and light stabilizers. To improve the feel of the golf ball when struck with a golf club, various types of non-ionomer thermoplastic elastomers may be blended in addition to the above essential components. Examples of non-ionomer thermoplastic elastomers include thermoplastic olefin elastomers, thermoplastic styrene elastomers, thermoplastic ester elastomers and thermoplastic urethane elastomers. Of these, the use of thermoplastic olefin elastomers and thermoplastic styrene elastomers is especially preferred.

For the heated mixture, it is critical that the components be compounded in specific relative proportions. In composition (1) containing 100 parts by weight of component (a), the amount of component (b) blended is at least 5 parts, especially at least 8 parts by weight and up to 80 parts, preferably up to 40 parts, especially up to 20 parts by weight, and the amount of component (c) blended is at least 0.1 part, especially at least 1 part by weight and up to 10 parts, especially up to 5 parts by weight.

In composition (2) containing 100 parts by weight of component (d), the amount of component (b) blended is at least 5 parts, especially at least 8 parts by weight and up to 80 parts, preferably up to 40 parts, especially up to 20 parts by weight, and the amount of component (c) blended is at least 0.1 part, especially at least 0.5 part by weight and up to 10 parts, especially up to 5 parts by weight.

In composition (3) containing 100 parts by weight of components (a) and (d) combined, the amount of component (b) blended is at least 5 parts, especially at least 8 parts by weight and up to 80 parts, preferably up to 40 parts, especially up to 20 parts by weight, and the amount of component (c) blended is at least 0.1 part, especially at least 0.7 part by weight and up to 10 parts, especially up to 5 parts by weight.

In any of compositions (1) to (3), too little component (b) lowers the melt viscosity, resulting in inferior processability, whereas too much detracts from the durability. Too little component (c) fails to improve the thermal stability and resilience, whereas too much component (c) instead lowers the heat resistance of the heated mixture due to the presence of excess basic inorganic metal compound. In any case, the heated mixture becomes useless.

The golf ball of the invention may be arrived at by forming the intermediate layer or cover from the heated mixture of any of the above-described compositions (1) to (3). In any case, the melt index of the heated mixture, as measured in accordance with JIS-K6760 at a temperature of 190° C. and under a load of 21 N (2.16 kgf), must be at least 1.0 dg/min, and is preferably at least 1.5 dg/min, and most preferably at least 2.0 dg/min. If the heated mixture has too low a melt index, the processability decreases markedly. It is recommended that the melt index be not more than 20 dg/min, and preferably not more than 15 dg/min.

The heated mixture is preferably characterized in terms of the relative absorbance in infrared absorption spectroscopy, representing the ratio of absorbance at the absorption peak attributable to carboxylate stretching vibrations normally detected at 1530 to 1630 $cm^{-1}$ to the absorbance at the absorption peak attributable to carbonyl stretching vibrations normally detected at 1690 to 1710 $cm^{-1}$. For the sake of clarity, this ratio may be expressed as follows: (absorbance of absorption peak for carboxylate stretching vibrations)/(absorbance of absorption peak for carbonyl stretching vibrations). Here, "carboxylate stretching vibrations" refers to vibrations by carboxyl groups from which the proton has dissociated (metal ion-neutralized carboxyl groups), whereas "carbonyl stretching vibrations" refers to vibrations by undissociated carboxyl groups. The ratio in these respective peak intensities depends on the degree of neutralization. In the ionomer resins having a degree of neutralization of about 50 mol % which are commonly used, the ratio between these peak absorbances is about 1:1.

To improve the thermal stability, moldability and resilience of the material, it is recommended that the heated mixture have a carboxylate stretching vibration peak absorbance which is at least 1.5 times, and preferably at least 2 times, the carbonyl stretching vibration peak absorbance. The absence of a carbonyl stretching vibration peak altogether is especially preferred.

The thermal stability of the heated mixture can be measured by thermogravimetry. It is recommended that, in thermogravimetric analysis, the heated mixture have a weight loss at 250° C., based on the weight of the mixture at 25° C., of not more than 2% by weight, preferably not more than 1.5% by weight, and most preferably not more than 1% by weight.

The heated mixture may have any desired specific gravity although it is generally advisable for the specific gravity to be at least 0.9, but not more than 1.5, preferably not more than 1.3 and most preferably not more than 1.1.

The heated mixture can be prepared by mixing and heating the components of any of compositions (1) to (3) in a well-known manner. For instance, such heat mixing is achieved, for instance, by mixing the components in an internal mixer such as a twin-screw extruder, a Banbury mixer or a kneader and heating at a temperature of about 150 to 250° C. Where various additives are to be added, any suitable method may be used to incorporate the additives together with the essential components. For example, the essential components and the additives are simultaneously heated and mixed. Alternatively, the essential components are premixed before the additives are added thereto and the overall composition heated and mixed.

In the golf ball of the invention, the intermediate layer and/or the cover is formed from the above heated mixture while it is not critical how to form the intermediate layer or cover. Either of the intermediate layer and the cover may be formed, for example, by injection molding or compression molding. In the case of injection molding, one typical procedure which can be employed involves setting a preformed solid core in place in an injection mold and introducing the material into the mold. Where the compression molding technique is employed, a pair of half cups are prepared from the relevant material, a preformed solid core is enclosed with the pair of half cups directly or with an intermediate layer interposed therebetween, and heat compression molding is effected in a mold. Appropriate conditions for heat compression molding include a temperature of about 120 to 170° C. and a time of about 1 to 5 minutes.

According to the invention, the intermediate layer and/or cover is formed from the heated mixture. Insofar as at least one of the intermediate layer and the cover is formed of the heated mixture, it may be combined with an intermediate layer or cover of a well-known material.

For instance, when the cover is formed of the heated mixture, the intermediate layer may be formed of well-known materials, for example, the rubber compositions illustrated above for the core and thermoplastic resins.

The thermoplastic resins of which the intermediate layer can be formed are preferably ionomer resins and thermoplastic elastomers. Illustrative examples include polyester, polyamide, polyurethane, polyolefin, and polystyrene thermoplastic elastomers. Specific commercial products of such elastomers include Hytrel (DuPont-Toray Co., Ltd.), Pelprene (Toyobo Co., Ltd.), Pebax (Elf Atochem), Pandex (Dainippon Ink & Chemicals, Inc.), Santoprene (Monsanto Chemical Co.) and Tuftec (Asahi Chemical Industry Co., Ltd.). Specific commercial products of ionomer resins include Himilan (Dupont-Mitsui Polychemicals Co., Ltd.), Surlyn (E.I. Dupont de Nemours and Company), and Iotek (Exxon Chemical Company).

It is noted that appropriate amounts of various additives such as inorganic fillers may be blended in the thermoplastic resins. Exemplary inorganic fillers are barium sulfate and titanium dioxide. They may be surface treated for facilitating dispersion in the base material.

The intermediate layer may be formed by any well-known technique even when it is made of materials other than the heated mixture. There may be used a molding technique similar to the above-mentioned techniques for forming the intermediate layer from the heated mixture.

When the intermediate layer is formed of the heated mixture, the cover may be formed of well-known materials, for example, thermoplastic resins.

The thermoplastic resins of which the cover can be formed are preferably ionomer resins and thermoplastic elastomers. For example, polyester, polyamide, polyurethane, polyolefin, polystyrene and other thermoplastic elastomers can be used although ionomer resins and thermoplastic polyurethane elastomers are preferred. Specific commercial products of ionomer resins include Himilan (Dupont-Mitsui Polychemicals Co., Ltd.), Surlyn (E.I. Dupont de Nemours and Company), Iotek (Exxon Chemical Company) and T-819 (Dainippon Ink & Chemicals, Inc.).

It is noted that appropriate amounts of various additives such as inorganic fillers may be blended in the cover-forming material. Exemplary inorganic fillers are the same as those mentioned above for the intermediate layer.

In forming the cover from the above material, an injection molding, compression molding or other molding technique may be used as in the case of the intermediate layer.

Regardless of whether each of the intermediate layer and the cover is a single layer formed of the heated mixture or a combination of a sublayer formed of the heated mixture with a sublayer of another material as exemplified above, it is recommended that each of the intermediate layer and the cover have an appropriate gage or radial thickness.

It is recommended that the intermediate layer be formed to a gage of usually at least 0.3 mm, preferably at least 0.5 mm, more preferably at least 0.7 mm and up to 3.0 mm, preferably up to 2.5 mm, more preferably up to 2.3 mm. Too thick an intermediate layer may fail to improve the feel and flight distance of the ball whereas too thin an intermediate layer may exacerbate the flight performance and durability of the ball.

It is recommended that the cover have a gage of usually at least 0.3 mm, preferably at least 0.5 mm, more preferably at least 0.7 mm and up to 3.0 mm, preferably up to 2.5 mm, more preferably up to 2.3 mm. Too thin a cover may be less durable and liable to crack whereas too thick a cover may exacerbate the feel.

It is also recommended that the total gage of the intermediate layer and the cover be usually at least 1.0 mm, preferably at least 1.3 mm and more preferably at least 1.5 mm. If the total gage is too small, the flight performance and durability of the ball may become poor. It is further recommended that the upper limit on the total gage of the intermediate layer and the cover be up to 5.5 mm, preferably up to 5.0 mm and more preferably up to 4.5 mm.

Regardless of whether each of the intermediate layer and the cover is a single layer formed of the heated mixture or a combination of a sublayer formed of the heated mixture with a sublayer of another material as exemplified above, it is required that each of the intermediate layer and the cover have a specific Shore D hardness.

Specifically, the intermediate layer should have a Shore D hardness of at least 40, preferably at least 45, more preferably at least 47 and up to 63, preferably up to 60, more preferably up to 58. A layer with a too low Shore D hardness is less resilient and may detract from travel distance.

The cover should have a Shore D hardness of at least 45, preferably at least 48, more preferably at least 50 and up to 68, preferably up to 65, more preferably up to 60. A cover with a too low Shore D hardness is less resilient and detracts from travel distance whereas a cover with a too high Shore D hardness gives a hard feel. As understood from the above range, the cover sometimes has a lower Shore D hardness than conventional covers, because the combination of the invention helps enhance the playability of the ball at no sacrifice of resilience even when the cover has such a low hardness.

According to the invention, the Shore D hardness of the intermediate layer and the Shore D hardness of the cover are optimized in relation to the Shore D hardness of the solid core at its center whereby the overall hardness distribution of the ball is prescribed.

When the Shore D hardness is compared among the solid core center, the intermediate layer and the cover, the invention requires: the hardness of the solid core at the center≦the hardness of the intermediate layer≦the hardness of the cover, and preferably the hardness of the solid core at the center≦the hardness of the solid core at the surface≦the hardness of the intermediate layer≦the hardness of the cover. More preferably, the ball is given the hardness distribution that the Shore D hardness gradually increases from the solid core center to the cover outer surface. If the Shore D hardness distribution is not optimized as above, the ball may have a poor feel or rebound. It is most preferred that the hardness difference between two adjacent layers be at least 3 Shore D hardness units.

As with conventional golf balls, the golf ball of the invention has a multiplicity of dimples formed on the surface. The shape, total number and other parameters of dimples are not critical. The dimples on the ball may be of one type, or of at least two types, and preferably of two to six types, having different diameters and/or depths. Regardless of the type, the dimples are preferably configured so as to have a diameter of 2.0 to 5.0 mm, and especially 2.2 to 4.5 mm, and a depth of 0.1 to 0.3 mm, and especially 0.11 to 0.25 mm. The total number of dimples is usually 350 to 500, and preferably 370 to 470. Dimples often have a planar shape that is circular, although the dimples may also have elliptical, oval, polygonal or other non-circular shapes. Also the ball surface is subjected to various finishing treatments such as priming, stamping and painting. Such finishing treatments are effectively conducted, especially on the cover formed of the heated mixture.

The golf balls of the invention are suited for competition play and comply with the Rules of Golf. They are constructed to a diameter of not less than 42.67 mm and a weight of not greater than 45.93 grams.

There have been described multi-piece golf balls which are significantly improved in feel, control and flight performance.

EXAMPLE

Examples of the invention are given below by way of illustration and not by way of limitation.

Examples 1–6 and Comparative Examples 1–3

Using the rubber materials shown in Table 1, solid cores were prepared to the diameter, weight and hardness shown in Table 3.

Using the resin materials shown in Table 2, intermediate layers and covers were successively formed on the solid cores in a conventional manner and in the combination shown in Table 3.

Compositions F and G listed as the resin material in Table 2 were useless. That is, the resin became solidified during mixing because component (b) was omitted and component (a) was so highly neutralized with component (c). It is noted that compositions H, I and J are ionomer resins well known as the materials for golf ball intermediate layer and cover.

The following characteristics were measured or evaluated for the golf balls obtained in each of the above examples. The results are shown in Tables 2 and 3.

Extrudability

Each of the materials was rated as follows for its moldability when worked at 200° C. in an intermeshing co-rotating type twin-screw extruder (screw diameter, 32 mm; main motor power, 7.5 kW) such as is commonly used for mixing materials.

Good: Extrudable

Poor: Cannot be extruded due to excess loading

Degree of Neutralization

Of all the acid groups (including acid groups on fatty acids or fatty acid derivatives) present in the heated mixture, the mole fraction of acid groups neutralized with transition metal ions was computed from the acid content, degree of neutralization, and molecular weight of the starting materials.

Compounding Ratio of Transition Metal Ions

The mole fraction of transition metal ions among the metal ions which neutralize the acid groups present on the heated mixture was computed from the acid content, degree of neutralization and molecular weight of the starting materials.

Melt Index

The melt flow rate of the material was measured in accordance with JIS-K6760 at a temperature of 190° C. and under a load of 21 N (2.16 kgf).

Percent Weight Loss

Prior to measurement, samples were dried in a dry hopper at 50° C. for 24 hours for eliminating the influence of moisture. Thermogravimetric analysis was carried out on approximately 5 mg samples by raising the temperature from 25° C. to 300° C. in a nitrogen atmosphere (flow rate, 100 ml/min) at a rate of 10° C./min, then calculating the percent loss in the sample weight at 250° C. relative to the sample weight at 25° C.

Relative Absorbance of Carboxylate Absorption Peak

A transmission method was used to measure the infrared absorption of the samples. In the infrared absorption spectrum for a sample prepared to such a thickness as to make the peak transmittance associated with hydrocarbon chains observed near 2900 $cm^{-1}$ about 90%, the absorption peak due to carbonyl stretching vibrations (1690 to 1710 $cm^{-1}$) was assigned an absorbance value of 1 and the ratio thereto of the absorption peak due to carboxylate strength vibrations (1530 to 1630 $cm^{-1}$) was computed as the relative absorbance. Ball Hardness:

Measured as the deflection (in millimeters) of the ball under a load of 100 kg.

Initial Velocity, Carry, Total

Using a hitting machine (by Miyamae K.K.) equipped with a driver (PRO230 Titan by Bridgestone Sports Co., Ltd.), the ball was hit at a head speed (HS) of 45 m/s and 35 m/s. A high speed camera was used to take photographs of the ball immediately after the impact, from which the initial velocity was computed. The carry and total distance were measured under the same conditions as above.

Trade names and materials mentioned in the tables are described below.

Nucrel AN4318: An ethylene-methacrylic acid-acrylate copolymer made by DuPont-Mitsui Polychemicals Co., Ltd. Acid content, 8 wt %. Ester content, 17 wt %.

Nucrel 1560: An ethylene-methacrylic acid copolymer made by DuPont-Mitsui Polychemicals Co., Ltd. Acid content, 15 wt %.

Himilan AM7316: A three-component zinc ionomer produced by DuPont-Mitsui Polychemicals Co., Ltd. Acid content, 10 wt %. Degree of neutralization, 50 mol %. Ester content, 24 wt %.

Surlyn 6320: A three-component magnesium ionomer produced by E.I. DuPont de Nemours and Company. Acid content, 10 wt %. Degree of neutralization, 50 mol %. Ester content, 24 wt %.

Himilan AM7311: A magnesium ionomer produced by DuPont-Mitsui Polychemicals Co., Ltd. Acid content, 15 wt %. Degree of neutralization, 54 mol %.

Behenic acid: Produced by NOF Corp. under the trade name NAA-222S.

Magnesium stearate: produced by NOF Corp. under the trade name Magnesium Stearate.

Magnesium oxide: A highly active type of magnesium oxide produced by Kyowa Chemical Industry Co., Ltd. under the trade name Micromag 3-150.

Calcium hydroxide: produced by Kanto Chemical Co., Ltd. 1st grade reagent

TABLE 1

| Composition | Example | | | | | | Comparative Example | | |
|---|---|---|---|---|---|---|---|---|---|
| (pbw) | 1 | 2 | 3 | 4 | 5 | 6 | 1 | 2 | 3 |
| Cis-1,4-polybutadiene | 100 | 100 | 100 | 100 | 100 | 100 | 100 | 100 | 100 |
| Zinc diacrylate | 24.0 | 24.0 | 24.0 | 21.3 | 15.8 | 18.5 | 24.0 | 15.8 | 18.5 |
| Dicumyl peroxide | 1.2 | 1.2 | 1.2 | 1.2 | 1.2 | 1.2 | 1.2 | 1.2 | 1.2 |
| Antioxidant | 0.2 | 0.2 | 0.2 | 0.2 | 0.2 | 0.2 | 0.2 | 0.2 | 0.2 |
| Zinc oxide | 5.0 | 5.0 | 5.0 | 5.0 | 5.0 | 5.0 | 5.0 | 5.0 | 5.0 |
| Barium sulfate | 28.6 | 28.6 | 28.6 | 29.7 | 31.9 | 36.2 | 28.6 | 31.9 | 36.2 |

TABLE 2

| | | A | B | C | D | E | F | G | H | I | J |
|---|---|---|---|---|---|---|---|---|---|---|---|
| Composition (pbw) | | | | | | | | | | | |
| Component (a) | Nucrel AN4318 | | 100 | | 50 | | 100 | | | | |
| | Nucrel 1560 | | | 20 | | | | 20 | | | |
| Component (d) | Himilan AM7316 | 100 | | 80 | 50 | | | 80 | | | |
| | Surlyn 6320 | | | | | 100 | | | 80 | 50 | 20 |
| | Himilan AM7311 | | | | | | | | 20 | 50 | 80 |
| Component (b) | Behenic acid | 20 | 20 | 20 | 20 | | | | | | |
| | Magnesium stearate | | | | | 20 | | | | | |
| Component (c) | Magnesium oxide | 1.6 | | | | | 3 | | | | |
| | Calcium hydroxide | | 4.8 | 3.3 | 3.5 | | | 3 | | | |
| Titanium dioxide | | 2 | 2 | 2 | 2 | 2 | 2 | 2 | | | |
| Resin properties | | | | | | | | | | | |
| Extrudability | | Good | Good | Good | Good | Good | Poor | Poor | Good | Good | Good |
| Degree of neutralization (mol %) | | 79 | 85 | 73 | 76 | 68 | 100 | 100 | 51 | 52 | 53 |
| Transition metal ion compounding ratio | | 42 | 0 | 34 | 24 | 0 | 0 | 36 | 0 | 0 | 0 |
| Melt index (dg/min) | | 2.5 | 1.9 | 4.8 | 2.3 | 2.5 | ≦1.0 | ≦1.0 | 0.9 | 0.9 | 0.8 |
| Weight loss (wt %) | | 1.2 | 0.5 | 1.4 | 0.7 | 2.5 | — | — | 1.2 | 1.2 | 1.2 |
| Relative absorbance of carboxylate peak | | 2.1 | 2.3 | 1.8 | 2 | 1.5 | — | — | 1.1 | 1.1 | 1.1 |
| Specific gravity | | 0.97 | 0.97 | 0.97 | 0.97 | 0.97 | — | — | 0.97 | 0.97 | 0.97 |
| Shore D hardness | | 50 | 50 | 54 | 50 | 50 | — | — | 50 | 54 | 59 |

TABLE 3

| | | Example | | | | | | Comparative Example | | |
|---|---|---|---|---|---|---|---|---|---|---|
| | | 1 | 2 | 3 | 4 | 5 | 6 | 1 | 2 | 3 |
| Core | Diameter (mm) | 36.5 | 36.5 | 36.5 | 36.5 | 36.5 | 35.3 | 36.5 | 36.5 | 35.3 |
| | Hardness (mm) | 3.8 | 3.8 | 3.8 | 4.2 | 5.0 | 4.5 | 3.8 | 5.0 | 4.5 |
| | Shore D hardness at center | 34.8 | 34.5 | 34.5 | 32.4 | 28.3 | 30.9 | 34.8 | 28.3 | 30.9 |
| | Shore D hardness at surface | 45.8 | 45.5 | 45.5 | 43.3 | 38.8 | 41.6 | 45.8 | 38.8 | 41.6 |
| Inter-mediate layer | Gage (mm) | 1.6 | 1.6 | 1.6 | 1.6 | 1.6 | 1.7 | 1.6 | 1.6 | 1.7 |
| | Shore D hardness | 50 | 50 | 50 | 50 | 54 | 50 | 50 | 54 | 50 |
| | Composition | A | B | H | B | C | D | E | I | H |
| Cover | Gage (mm) | 1.5 | 1.5 | 1.5 | 1.5 | 1.5 | 2.0 | 1.5 | 1.5 | 2.0 |
| | Shore D hardness | 54 | 54 | 54 | 59 | 59 | 59 | 54 | 59 | 59 |
| | Composition | I | I | C | J | J | J | I | J | J |
| Ball | Diameter (mm) | 42.7 | 42.7 | 42.7 | 42.7 | 42.7 | 42.7 | 42.7 | 42.7 | 42.7 |
| | Weight (g) | 45.3 | 45.3 | 45.3 | 45.3 | 45.3 | 45.3 | 45.3 | 45.3 | 45.3 |
| Flight performance @HS45 | Initial velocity (m/s) | 64.4 | 64.5 | 64.4 | 64.4 | 64.3 | 64.4 | 63.8 | 63.6 | 63.7 |
| | Carry (m) | 207.3 | 208.0 | 207.5 | 207.1 | 207.0 | 207.5 | 204.3 | 204.0 | 204.4 |
| | Total (m) | 227.2 | 228.0 | 227.5 | 228.2 | 227.5 | 227.8 | 222.8 | 223.0 | 223.1 |
| Flight performance @HS35 | Initial velocity (m/s) | 50.2 | 50.2 | 50.2 | 50.3 | 50.4 | 50.3 | 49.7 | 49.9 | 49.8 |
| | Carry (m) | 141.8 | 142.0 | 142.2 | 142.2 | 142.4 | 142.1 | 139.1 | 139.8 | 139.6 |
| | Total (m) | 155.0 | 155.3 | 155.3 | 155.5 | 155.7 | 155.5 | 152.0 | 153.0 | 152.7 |

The following is evident from Table 3. A comparison is first made of Examples 1 to 3 with Comparative Example 1. Although these golf balls were identical in the diameter and hardness (deflection under 100 kg load) of the solid core and the gage and Shore D hardness of the intermediate layer and the cover, the multi-piece golf balls of Examples 1 to 3 showed high rebound and traveled a longer carry and total distance at both the head speeds of 45 m/s and 35 m/s, whereas the multi-piece golf ball of Comparative Example 1 showed poor rebound and traveled a shorter distance. Next, a comparison is made of Example 5 with Comparative Example 2 and of Example 6 with Comparative Example 3, which were identical in the diameter and hardness (deflection under 100 kg load) of the solid core and the gage and Shore D hardness of the intermediate layer and the cover. The golf balls of Examples 5 and 6 showed high rebound and traveled a longer distance whereas the golf balls of Comparative Examples 2 and 3 were inferior in rebound and distance. Although the golf ball of Example 4 was identical in the diameter of the solid core and the gage and hardness of the intermediate layer and the cover with the golf ball of Comparative Example 2, the golf ball of Example 4 was superior in rebound and travel distance to Comparative Example 2.

The golf ball of Comparative Example 1 was found to show poor rebound since it had the intermediate layer formed of composition E, i.e., a resin material which was thermally unstable because of the absence of component (c).

Japanese Patent Application No. 2000-033183 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A multi-piece golf ball comprising a solid core, an intermediate layer enclosing the solid core, and a cover enclosing the intermediate layer, wherein at least one of said intermediate layer and said cover is formed of a heated mixture comprising (a) 100 parts by weight of an olefin-unsaturated carboxylic acid random copolymer or an olefin-unsaturated carboxylic acid-unsaturated carboxylate random copolymer or both, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (a) and (b), said heated mixture having a melt index of at least 1.0 dg/min, said intermediate layer has a Shore D hardness of 40 to 63, said cover has a Shore D hardness of 45 to 68, the Shore D hardness of said solid core at its center is not greater than the Shore D hardness of said intermediate layer, which is not greater than the Shore D hardness of said cover.

2. The multi-piece golf ball of claim 1 wherein said solid core is formed of a polybutadiene-based rubber composition and has a diameter of 33 to 41 mm and a deflection of 2.5 to 7.0 mm under an applied load of 100 kg.

3. The multi-piece golf ball of claim 1 wherein said intermediate layer has a gage of 0.3 to 3.0 mm, said cover has a gage of 0.3 to 3.0 mm, and the total gage of said intermediate layer and said cover is at least 1.0 mm.

4. A multi-piece golf ball comprising a solid core, an intermediate layer enclosing the solid core, and a cover enclosing the intermediate layer, wherein at least one of said intermediate layer and said cover is formed of a heated mixture comprising (d) 100 parts by weight of a metal ion-neutralized olefin-unsaturated carboxylic acid random copolymer or a metal ion-neutralized olefin-unsaturated carboxylic acid-unsaturated carboxylate random copolymer or both, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (d) and (b), said heated mixture having a melt index of at least 1.0 dg/min, said intermediate layer has a Shore D hardness of 40 to 63, said cover has a Shore D hardness of 45 to 68, the Shore D hardness of said solid core at its center is not greater than the Shore D hardness of said intermediate layer, which is not greater than the Shore D hardness of said cover.

5. A multi-piece golf ball comprising a solid core, an intermediate layer enclosing the solid core, and a cover enclosing the intermediate layer, wherein at least one of said intermediate layer and said cover is formed of a heated mixture comprising 100 parts by weight of a mixture of (a) an olefin-unsaturated carboxylic acid random copolymer or an olefin-unsaturated carboxylic acid-unsaturated carboxylate random copolymer or both and (d) a metal ion-neutralized olefin-unsaturated carboxylic acid random copolymer or a metal ion-neutralized olefin-unsaturated carboxylic acid-unsaturated carboxylate random copolymer or both, (b) 5 to 80 parts by weight of a fatty acid or fatty acid derivative having a molecular weight of at least 280, and (c) 0.1 to 10 parts by weight of a basic inorganic metal compound capable of neutralizing acid groups in components (a), (d) and (b), said heated mixture having a melt index of at least 1.0 dg/min, said intermediate layer has a Shore D hardness of 40 to 63, said cover has a Shore D hardness of 45 to 68, the Shore D hardness of said solid core at its center is not greater than the Shore D hardness of said intermediate layer, which is not greater than the Shore D hardness of said cover.

* * * * *